US006253393B1

(12) United States Patent
Dries et al.

(10) Patent No.: US 6,253,393 B1
(45) **Date of Patent: *Jul. 3, 2001**

(54) DOOR FOR SHOWER ENCLOSURE

(76) Inventors: Armin Dries; Susanne Wegener, both of Dresdner Strasse 18, 63110 Rodgau (Nieder-Roden) (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/720,466

(22) Filed: Sep. 30, 1996

Related U.S. Application Data

(63) Continuation of application No. PCT/DE96/00120, filed on Jan. 29, 1996, now abandoned.

(51) Int. Cl.[7] ..... A47K 3/00

(52) U.S. Cl. ..... 4/607; 4/610; 49/104; 16/365; 16/370

(58) Field of Search ..... 4/557, 607, 610, 4/614; 49/104, 109, 122; 16/365, 366, 370

(56) References Cited

U.S. PATENT DOCUMENTS

| | | | | |
|---|---|---|---|---|
| 1,116,817 | * | 11/1914 | Heller | 16/366 |
| 1,407,740 | | 2/1922 | Evans . | |
| 1,848,942 | * | 3/1932 | Fantaci | 49/109 |
| 1,848,978 | * | 3/1932 | Smith | 49/104 |
| 1,889,159 | | 11/1932 | Stoddard . | |
| 2,747,200 | * | 5/1956 | Finkel | 4/556 |
| 3,017,926 | | 1/1962 | Kauppila . | |
| 3,909,981 | | 10/1975 | Bergkamp et al. . | |

FOREIGN PATENT DOCUMENTS

| | | | | |
|---|---|---|---|---|
| 3310139 | * | 9/1984 | (DE) | 4/610 |
| 3839398 | * | 5/1990 | (DE) | 4/607 |
| 9203008 U | | 6/1992 | (DE) . | |
| 204321 | * | 12/1986 | (EP) | 4/557 |
| 2676636 | * | 11/1992 | (FR) | 4/607 |
| 64546 | * | 3/1942 | (NO) | 16/366 |
| 65269 | * | 9/1942 | (NO) | 16/366 |

* cited by examiner

*Primary Examiner*—Charles R. Eloshway
(74) *Attorney, Agent, or Firm*—Michael J. Striker

(57) ABSTRACT

A door for shower enclosures has at least two door leaves disposed side-by-side in a closed state of the door, a continuous vertical hinge element connecting the door leaves so that upon opening of the door one of the door leaves pivots forward about a rotary axis of the hinge element, a double hinge element mountable on one wall of a shower area or on a vertical profile of a shower enclosure and having a rear suspension part and a front suspension part, another of the door leaves being supported rotatably in a rotary axis by one face end on the rear suspension part of the double hinge element, at least one horizontally disposed rotating arm which is articulated rotatably in another rotary axis on the front suspension part of the double hinge element which is farther from the shower area than the rear suspension part, the retaining arm fitting over the hinge element and being supported rotatably by an opposite end in a further rotary axis of a further suspension part mounted rigidly on the hinge element.

12 Claims, 11 Drawing Sheets

Fig. 14
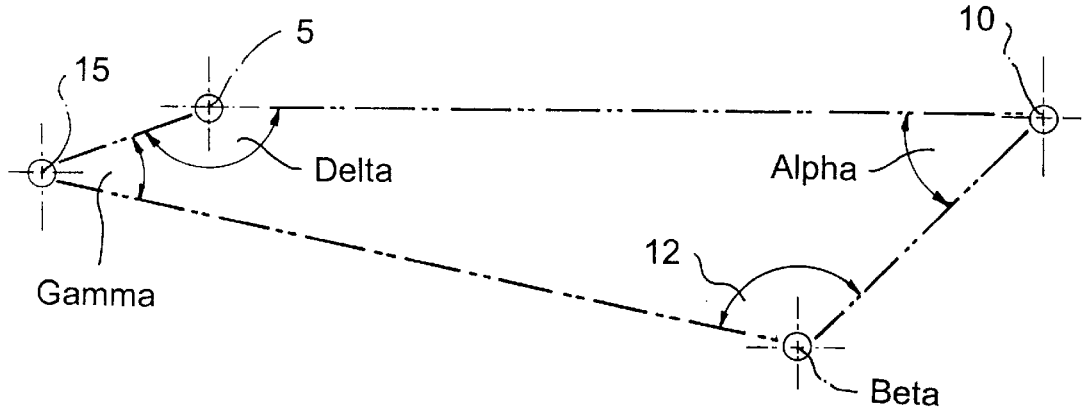
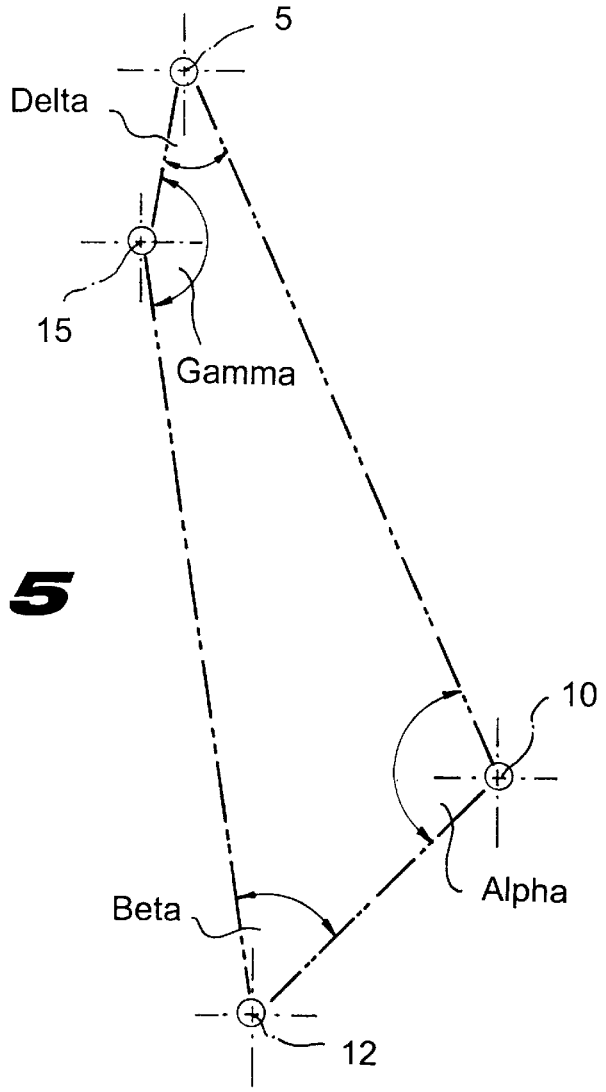
Fig. 15

DOOR FOR SHOWER ENCLOSURE

This application is a continuation of PCT/DE96/00120 filed on Jan. 29, 1996 now abandoned.

BACKGROUND OF THE INVENTION

The invention relates to a door for shower enclosures.

Showers or shower areas, if they are integrated in larger rooms such as bathrooms and the like and if the showers are not mounted in their own closed spaces, typically requiring enclosures to prevent the shower water (wastewater and splashing water) from entering the room around it. Depending on whether the shower enclosure is disposed out in the open in the room, or in the corner of a room, or in some especially partitioned-off portion of the room, either only one entry, in the form of a door, or in addition one or more fixed partitions, are needed.

The doors most often used for such shower enclosures are sliding doors, which comprise two or more parts (panels) disposed in separate guides in frame profiles one in front of the other; the frame profiles extend horizontally on the bottom or on the upper edge of the tub or shower pan on the one end and on the upper end of the shower enclosure on the other. These sliding doors have the disadvantage on the one hand that they allow only a relatively narrow entry space for the user. This is specifically true for two-part sliding doors. In closing doors with three and more parts, although there is a wider entrance space, nevertheless the construction expense for the additional door portions with the necessary guides in the frame profiles is considerably greater. In all forms of these sliding doors for shower enclosures, there is also the disadvantage that relatively complicated and expensive measures are needed for adequate sealing, specifically in the regions of overlap of the individual sliding door portions, and also for reliably diverting the water flowing down the door in the region of the lower frame profile. Another disadvantage is that all these sliding door constructions and thus the corresponding shower enclosures are highly unsatisfactory overall from an esthetic or design standpoint.

As an alternative, it is known to provide the entrance area of the shower enclosure with wing-type doors, which depending on the embodiment of the shower enclosure are mounted by means of hinges on vertical profiles along the lateral outer wall or on corresponding corner profiles of the shower enclosure, at the transition to the outer wall or walls thereof, and which either overlap one another or abut one another flush by their inner ends when closed. These wing-type doors do avoid disadvantages of the above-discussed sliding doors, because they require no frame profiles for guiding and securing the sliding doors and at the same time thereby enable more-satisfactory designing of the shower enclosures. However, in addition to the problem that they also have of adequate sealing in the region of the overlap or abutment of the two door panels of the wing-type door, they have the disadvantage that the user must separately open or close both parts of the door in order to enter the shower area or leave it. If he opens only one of the wing doors, then typically the passage is even narrower than in sliding doors. Another disadvantage is that because the two door panels are opened in opposite directions, then when both of them are opened, water that is on the insides of the doors after a shower then runs or drips from not merely one side but both sides into the outer room.

Finally, it is known to mount a unit-type door in shower enclosures that extends over the full width of the entrance side, or at least the predominant portion thereof. It is likewise mounted by hinges to a vertical profile on a lateral outer wall of the shower area or on a corresponding corner profile of the shower enclosure at the transition to the adjoining outer wall, and it opens into the room in front of the shower area. This embodiment does allow unhindered access and exit, and the user needs to open only one door leaf. Moreover, in this embodiment retaining and guide profiles are unnecessary; in addition, an esthetically satisfactory design of the shower enclosures is also possible. However, the considerable disadvantage arises that the wide door on being opened swings all the way into the room in front of the shower area, and thus a corresponding amount of free space must be left available. Pivoting of the door to the inside, for instance, is typically not an option, since the door would sweep over the greater majority of the inside surface area of the shower enclosure and the shower area and would thus be a hindrance both when the user enters and exits, and while the user is in the shower. Another disadvantage of this embodiment is that when the door is opened into the room, water adhering to the relatively large door surface drips or flows into the room from the full width of the door. Moreover, there is the structural problem of torsion of the door leaf, which when the usual hinges are used in this known embodiment requires the use of torsionally rigid door leaves, but even then does not satisfactorily solve the problem.

Finally, from German Utility Model DE-G 92 03 008.4, a door for shower enclosures is known which a frame as a supporting skeleton with support arms that are connected in an articulated manner by one end to the horizontally extending frame parts and by their opposite ends via roller bearings are displaceable in fixed upper and lower guide rails in the entry and exit region of the shower enclosure. Thus the door can be displaced inward toward an adjacent outside of the shower area. With this construction, it is admittedly accomplished that the user of the shower has the great majority of the door side of the shower enclosure available for entry and exit. The disadvantage of the above embodiment that the door after the shower is used extends with its full surface into the room with the splashed water adhering to it so that the water still unintentionally drips off or runs down, is avoided. On the other hand, the disadvantage arises then when the door is pivoted or slid inward, a large portion of the shower area is swept, which at least considerably limits the freedom of motion of the user on closing the door after entering and equally limits it when he exits. The disadvantage of the requisite guide rail as in the sliding door constructions still remains as well, and requires roller bearings in addition. Above all, additional components in the form of the cantilevered arms and their upper and lower connections to the door frame and to the guide rails are also necessary. Reliable guidance and an avoidance of warping or seizing of the door are possible, if at all, only at considerable effort and expense. Finally, the esthetic appearance of a shower enclosure with this kind of door construction is extremely unsatisfactory.

SUMMARY OF THE INVENTION

The object of the invention is to create a door for shower enclosures in which, while the disadvantages of the known constructions are avoided, frames and guide profiles for the door are unnecessary, the outer width of the shower area after the door is opened is maximally available to the user for entry and exit, splashing water is prevented as much as possible from flowing or dripping off the door once the door has opened into the room in front of the shower area, and twisting or warping of the door on opening and closing is precluded.

In keeping with these objects and with others which will become apparent hereinafter, one feature of present invention resides, briefly stated in a door for shower enclosure which comprises at least two door leaves disposed side-by-side in a closed state of the door; a continuous vertical hinge element connecting said door leaves so that upon opening of the door one of said door leaves pivots forward about a rotary axis of said hinge element; a double hinge element mountable on one wall of a shower area or on a vertical profile of a shower enclosure and having a rear suspension part and a front suspension part, another of said door leaves being supported rotatably in a rotary axis by one face end on said rear suspension part of said double hinge element; at least one horizontally disposed rotating arm which is articulated rotatably in another rotary axis on said front suspension part of said double hinge element which is farther from the shower area than said rear suspension part, said retaining arm fitting over said hinge element and being supported rotatably by an opposite end in a further rotary axis of a further suspension part mounted rigidly on said hinge element.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 14: a schematic illustration of the door of FIGS. 1 and 3 in the closed state, showing the imaginary horizontal lines through the four rotary axes 5, 10, 12 and 15 of the hinge element 4, the suspension part 14 and the double hinge element 9, with the angles that they form;

FIG. 15: a schematic illustration of the door of FIGS. 1 and 3 as in FIG. 14, but with the door fully open.

DESCRIPTION OF PREFERRED EMBODIMENTS

Figure 1:
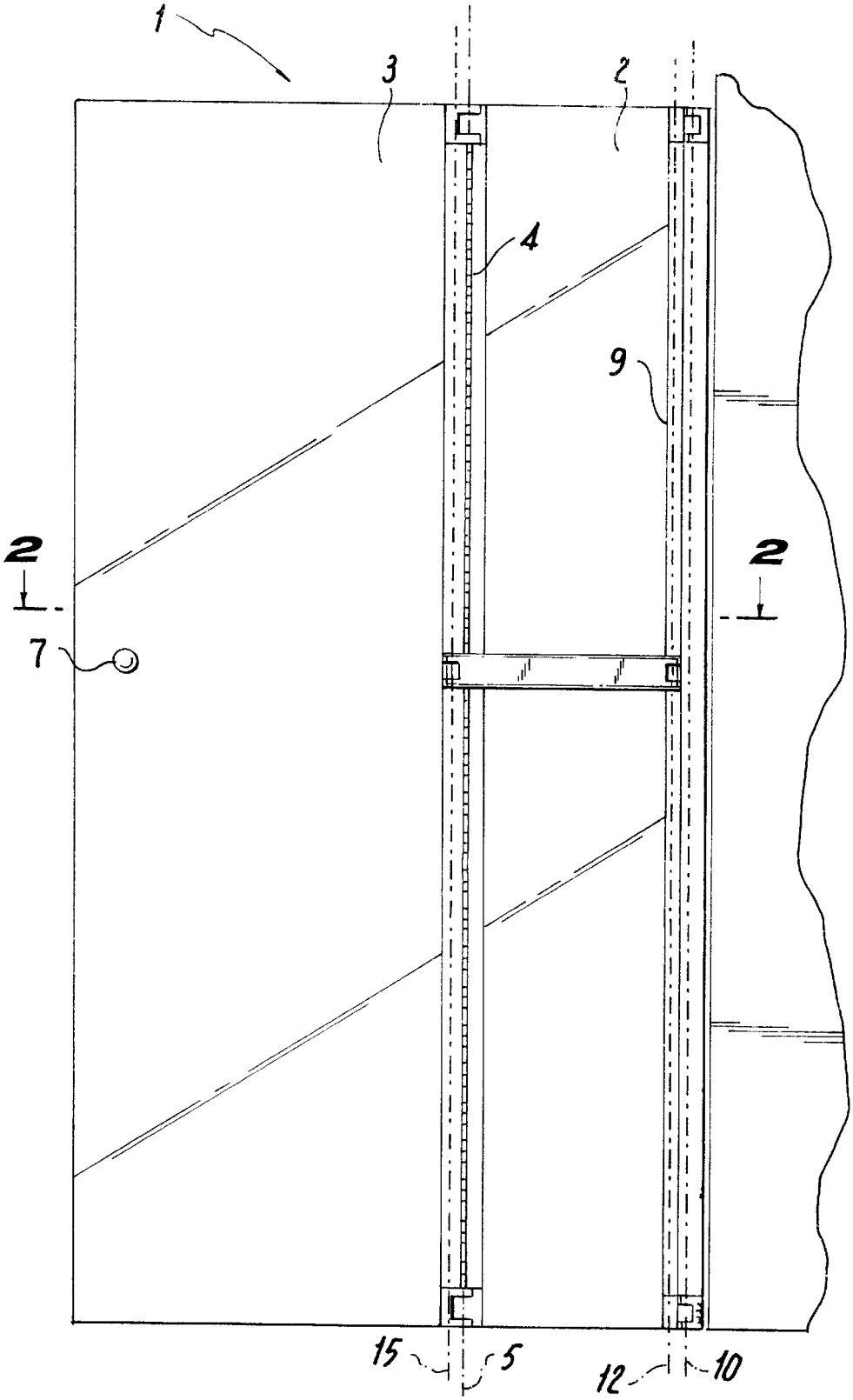
FIG. 1: the door in the embodiment with two door leaves, in a plan view from the outside, secured on the right-hand side to a wall of the room.
Figure 2:
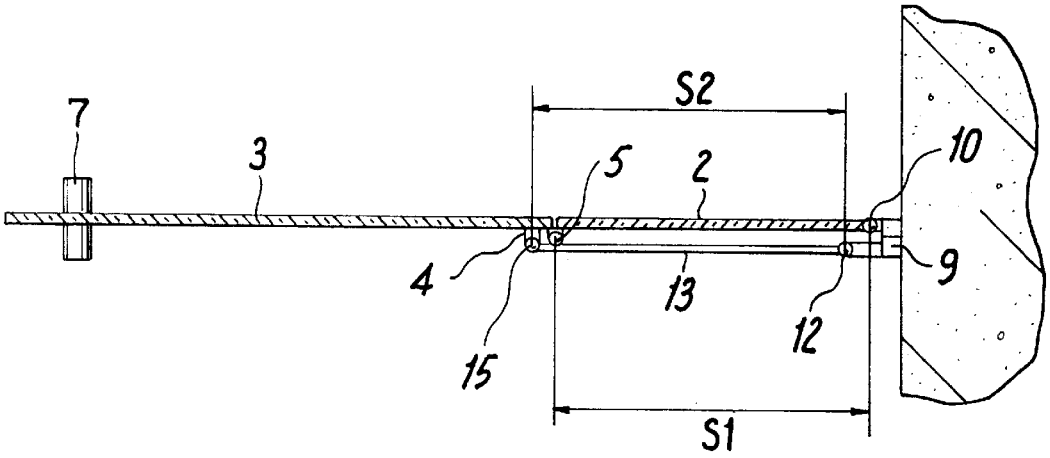
FIG. 2: a cross section through the door of FIG. 1 in its upper region.
Figure 3:
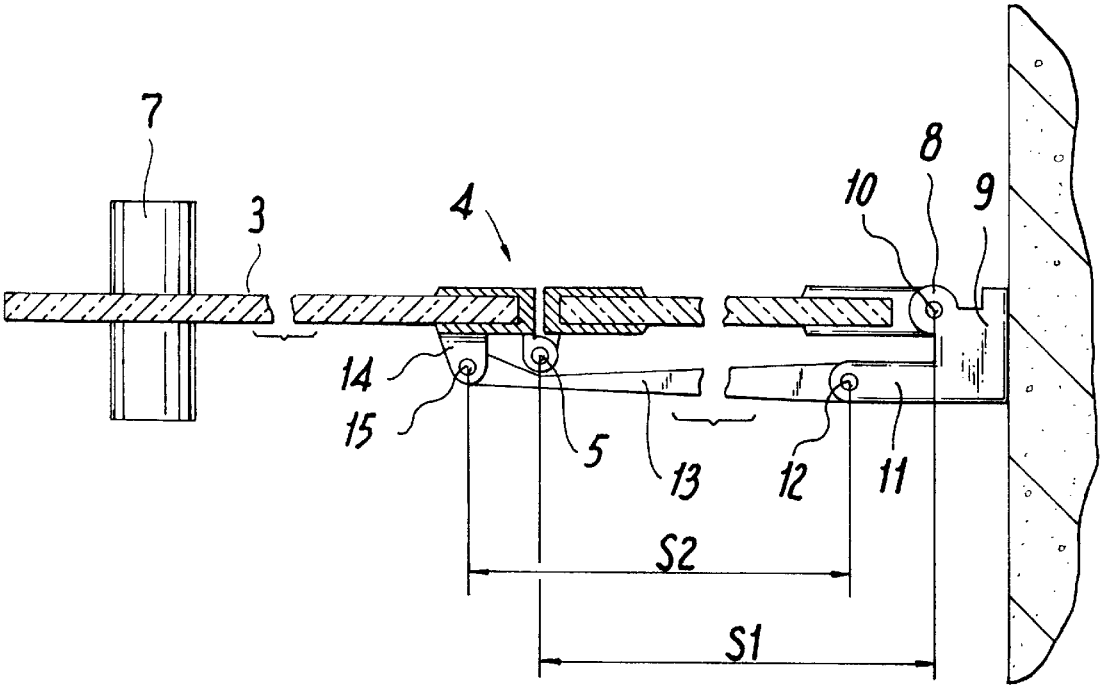
FIG. 3: the cross section of FIG. 2, on a larger scale.

The door 1 according to the invention as shown in FIGS. 1–5 comprises the door leaves 2 and 3; in the exemplary embodiment shown, the door leaf 2 has a lesser width than the door leaf 3. However, the two door leaves may also be of equal width or may have different width ratios. The two door leaves are joined by means of the hinge element 4, which as can be seen in FIG. 1 can extend as a strap hinge over the entire height of the door, or may comprise a plurality of individual hinges mounted at intervals. The hinge element 4 is mounted in such a way that the door leaf 3 pivots outward about the rotary axis 5 or in other words away from the shower area and the tub 6, when the user pulls on the handle 7 of the door leaf 3. With its other outer side, the door leaf 2, as shown in detail in FIG. 3, is mounted on the rear suspension part 8, in terms of the direction of view toward the shower enclosure, of a double hinge element 9, and is rotatably supported in it in the rotary axis 10. The double hinge element 9, when the door of the invention adjoins a room wall, is firmly mounted to this wall by known means. If the door is used in a shower enclosure without a direct connection to a room wall, then the double hinge element 9 is correspondingly firmly mounted to the corner profile of the shower enclosure. The double hinge element 9 may likewise be a component extending over the entire height of the door leaf 2 or a portion thereof, or may equally well comprise a plurality of double hinges mounted at intervals from one another.

The double hinge element 9 also has a front suspension part 11, in terms of the direction of view toward the shower enclosure, with the rotary axis 12; this suspension part protrudes farther in the direction of the door leaf 3 than the suspension part 8. In this suspension part 11, at least one horizontally extending retaining arm 13 is rotatably articulated, preferably midway along the height of the door 1. This retaining arm fits over the hinge element 4 and engages the suspension part 14 with the rotary axis 15, which in turn is rigidly mounted to the door leaf 3 adjacent the hinge element 4. The rotary axes 5 and 10 on the one hand and the rotary axes 12 and 15 on the other each have defined spacings S 1 and S 2, respectively, as shown in FIG. 3, specifically such that the spacing S 1 is larger than the spacing S 2. Moreover, the direct spacing of the imaginary horizontal line between the rotary axes 10 and 12 is greater than the direct spacing between the rotary axes 5 and 15, and the sum of the spacing between the rotary axes 10 and 12 on the one hand and between the rotary axes 12 and 15 on the other is greater than the sum of the spacing between the rotary axes 5 and 10 on the one hand and between the rotary axes 5 and 15 on the other.

If imaginary horizontal lines are drawn between the rotary axes 5 and 10, between the rotary axes 12 and 15, between the rotary axes 5 and 15, and between the rotary axes 10 and 12, then the result, as shown in FIG. 14, is the following relationship among the angles formed by these imaginary lines: the inside angle alpha is smaller than the inside angle beta; the inside angle gamma is smaller than the inside angle delta; the inside angle alpha is larger than the inside angle gamma, and the inside angle delta is larger than the inside angle beta. When the door is opened, the angles beta and delta become smaller, while the angles alpha and gamma each become larger. In the fully opened state of the door, the following angle ratios of the aforementioned imaginary lines result, as shown in FIG. 15: The inside angle alpha is larger than the inside angle beta, and the inside angle gamma is larger than the inside angle delta; the inside angle alpha is larger than the inside angle delta, but smaller than the inside angle gamma; the inside angle beta is smaller than the inside angle gamma, but larger than the inside angle delta.

Figure 5:
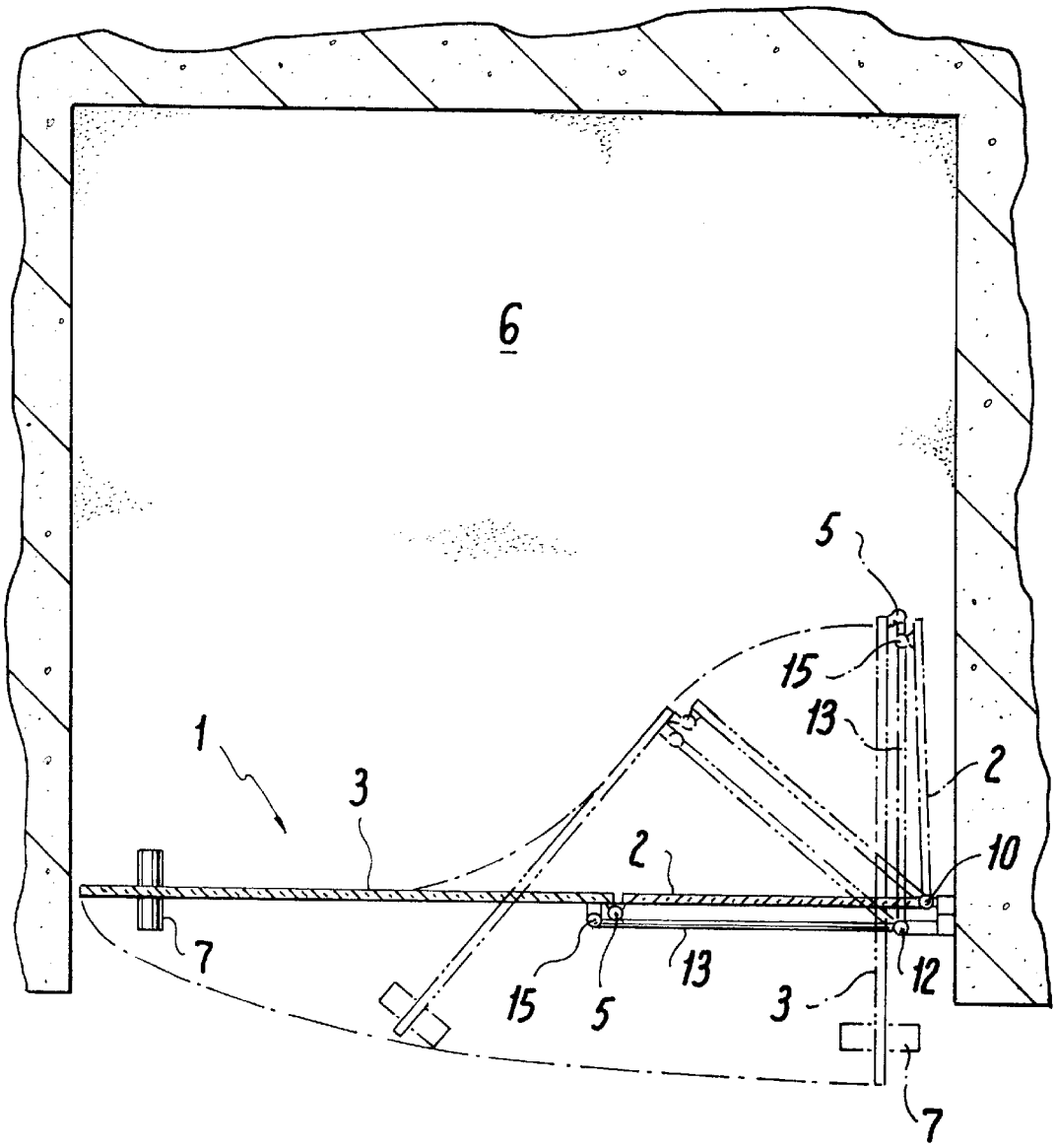
FIG. 5: the illustration as in FIG. 4, additionally showing the door as it is opened or closed.
Figure 6:
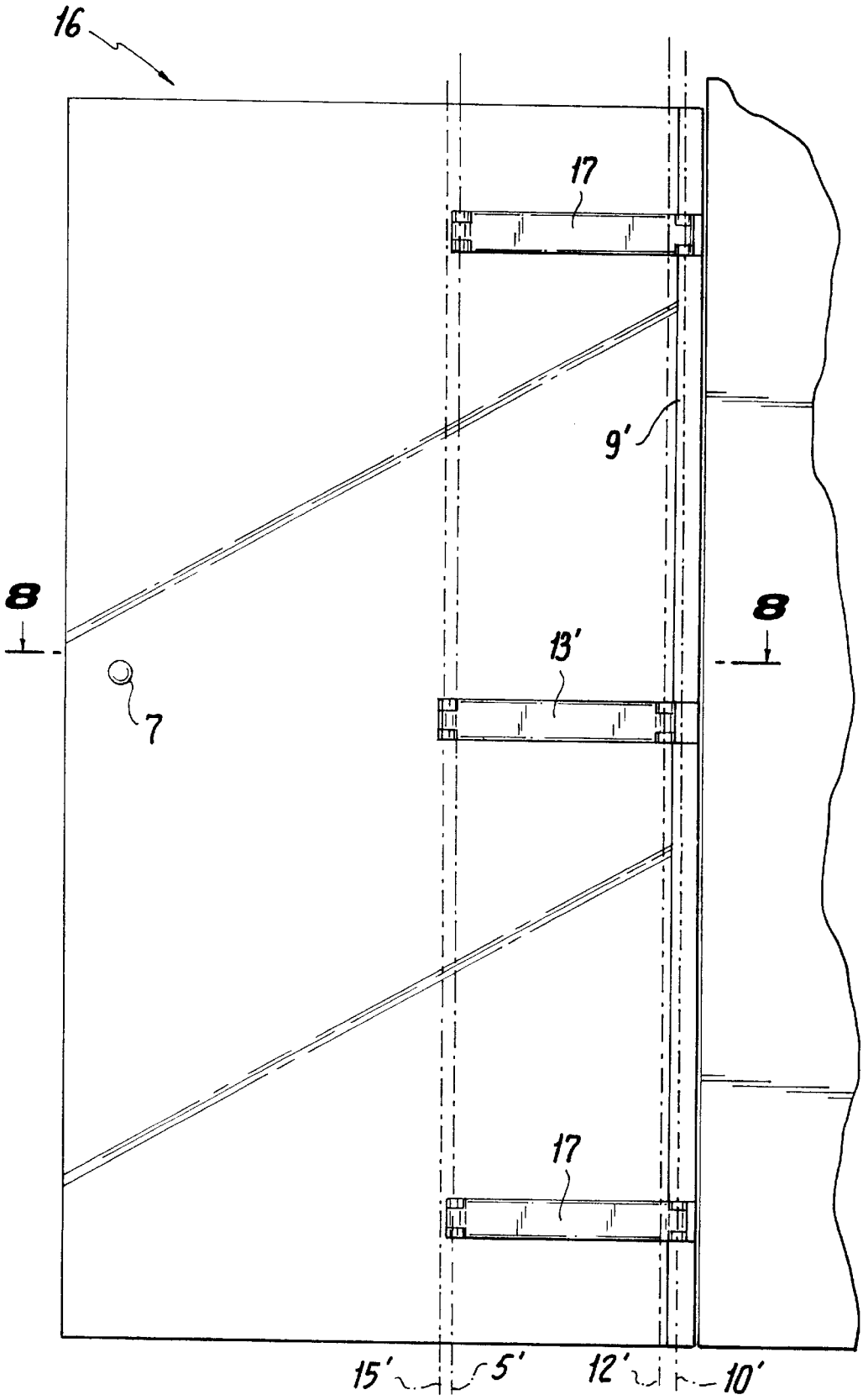
FIG. 6: the door in the embodiment with a unit-type door leaf and three retaining arms, in a plan view from the front in the direction of the shower area, secured on the right-hand side to a wall of the room.
Figure 7:
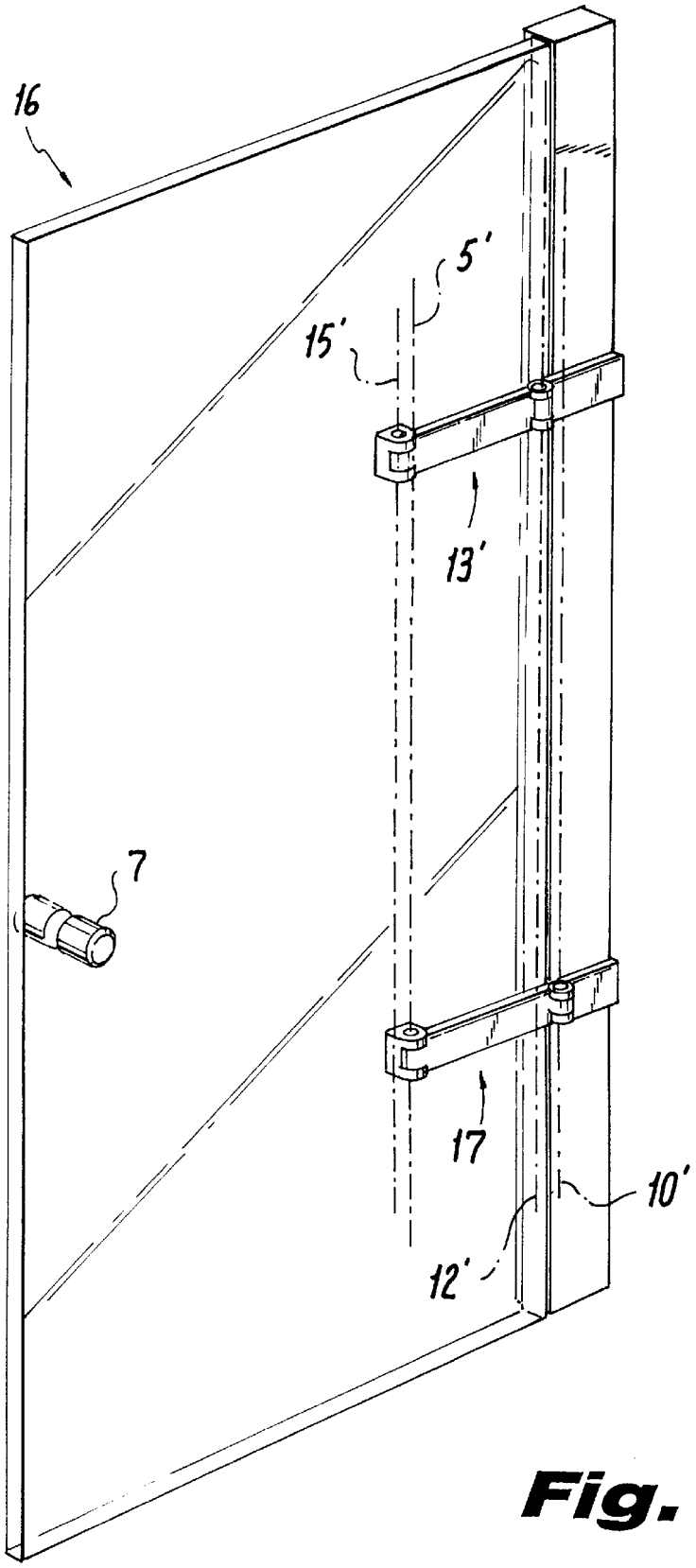
FIG. 7: the door of FIG. 6, but with only two retaining arms, in a three-dimensional view.
Figure 8:
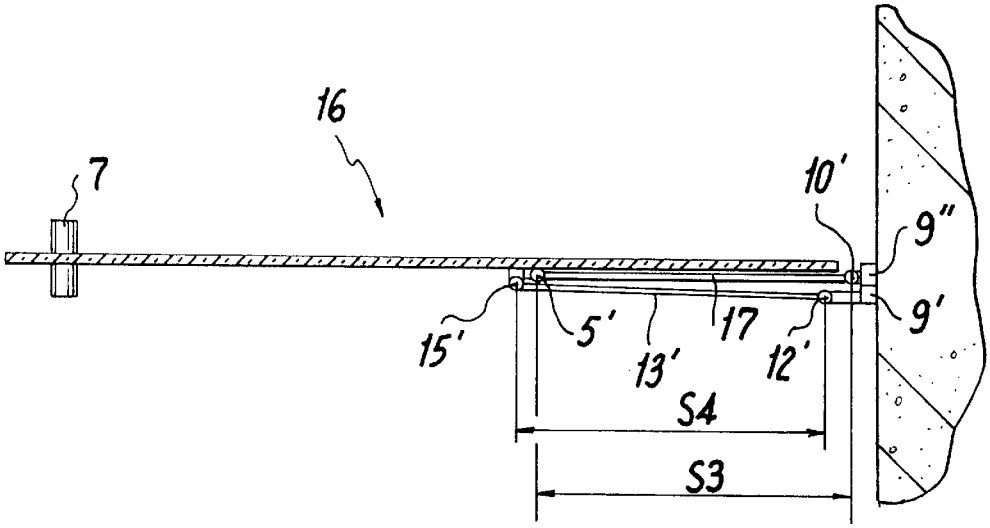
FIG. 8: a cross section through the door of FIGS. 6 and 7, with an illustration corresponding to FIG. 2.

If the user of the shower pulls on the handle 7 from outside, or presses against it on the inside, from the shower area, then the course of motion shown in FIG. 5 results. The door leaf 3 pivots forward via the rotary axes 5 and 15. At the same time, the door leaf 2, via the rotary axis 10 of the suspension part 8, by compulsion via the retaining arm 13, pivots in the rotary axis 12 of the suspension part 11 into the shower area. At the same time, via the rotary axes 5 and 15, the door leaf 3 is guided by compulsion over a portion of its width into the shower area.

Figure 4:
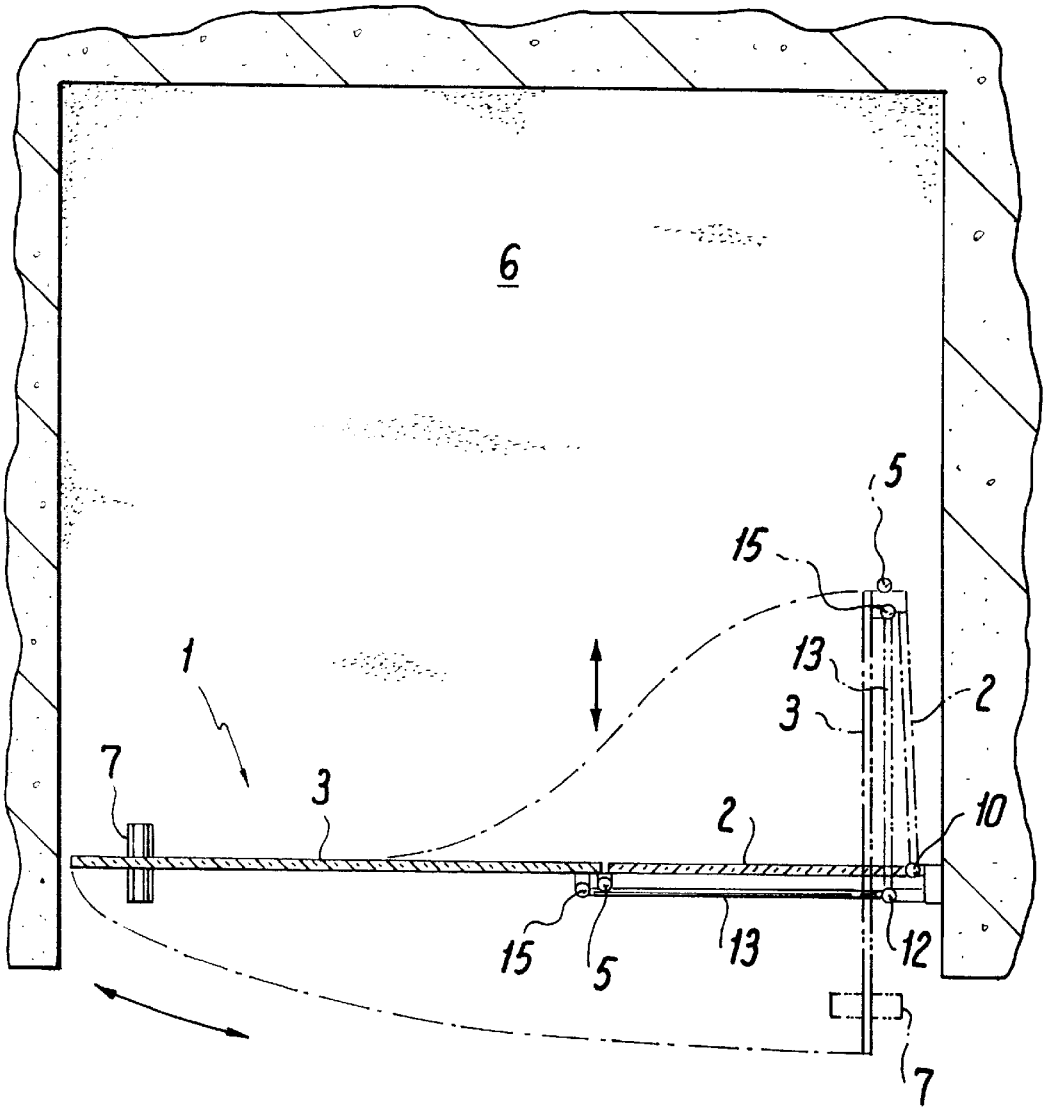
FIG. 4: a cross section through the door, as in FIGS. 2 and 3, but with an additional schematic illustration of the shower space or tub, showing the area swept by the door when it is opened or closed.

In the fully pulled- or pressed-open state, the door, as visible in FIGS. 4 and 5, is opened against the side wall of the room or the adjoining outer wall of the shower enclosure; the door leaf 3 extends with only a slight portion of its width into the room in front of the shower area 6. In FIGS. 4 and 5, grids represent the area swept by the door in the exemplary embodiment. It occupies only a small portion of the shower area and at the same time only a slight portion of the outer space in front of the shower enclosure.

If the width ratios of the door leaves 2 and 3 are changed, then while the technical design of the door is unchanged, the area it sweeps inside and outside the shower area 6 as it is opened or closed changes. Thus if the door leaf 2 is widened together with the door leaf 3, the door sweeps a larger area of the shower area 6. While the area swept by the door in the outer room is less, and in the completely pulled- or pressed-open state, the door leaf 3 extends into the outer room with a lesser portion of its width.

The door leaves 2 and 3 may individually or both be frameless, as in the case when glass panels are chosen as material, for instance. It is equally possible for one of the door leaves, in particular the door leaf 2, to be provided with an encompassing profile frame; in that case, the door leaf itself may be of thin, intrinsically non-torsion-resistant material, such as a lightweight plastic panel. It is equally possible for both door leaves 2 and 3 to be provided with frames.

In FIGS. 6–13, a further exemplary embodiment of the door 1 of the invention is shown, in which instead of the two door leaves 2 and 3, a single door leaf 16 is used for the full width of the door. The retaining arm 13' is substantially equivalent to the retaining arm 13 of the exemplary embodiment of FIGS. 1–5. It is inserted by one end horizontally rotatably in the suspension part 14' with the rotary axis 15'. The suspension part 14' is in turn rigidly secured to the door leaf 16 by known means, such as a screw fastening or adhesive bonding. By its other end, the retaining arm 13' is rotatably supported in the suspension part 11' with the rotary axis 12'. The suspension part 11' is a component of the hinge element 9', which in turn is rigidly secured to the lateral room wall, or in the case of a shower enclosure or corner shower to the vertical profile thereof.

Figure 9:
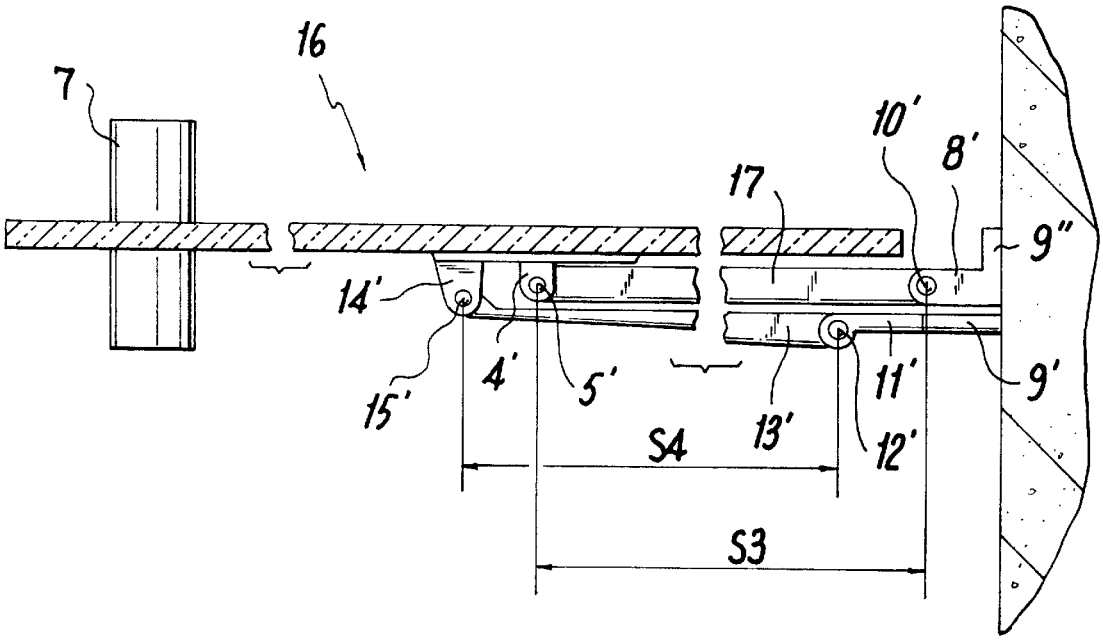
FIG. 9: the illustration of FIG. 8 on a larger scale.
Figure 10:
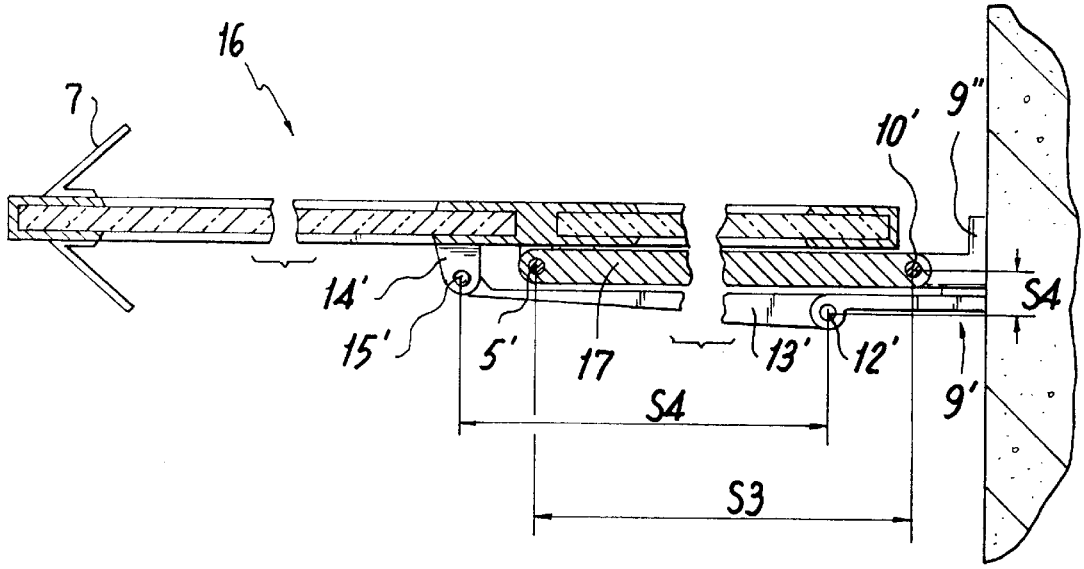
FIG. 10: the illustration of the door of FIGS. 6 and 9, with two panels firmly joined to one another by a connecting profile.
Figure 11:
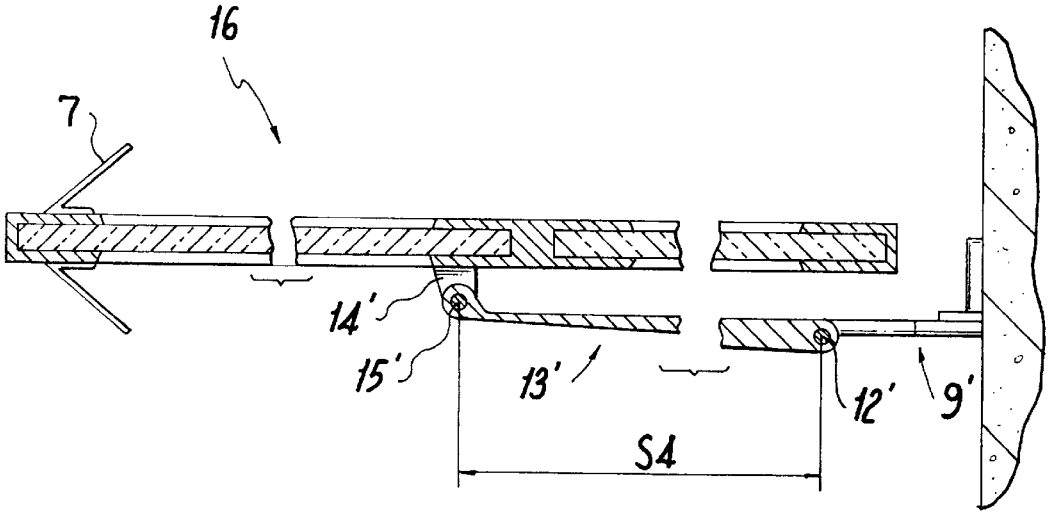
FIG. 11: a cross section through the door of FIG. 10 shows as a detail showing only the front retaining arm.
Figure 12:
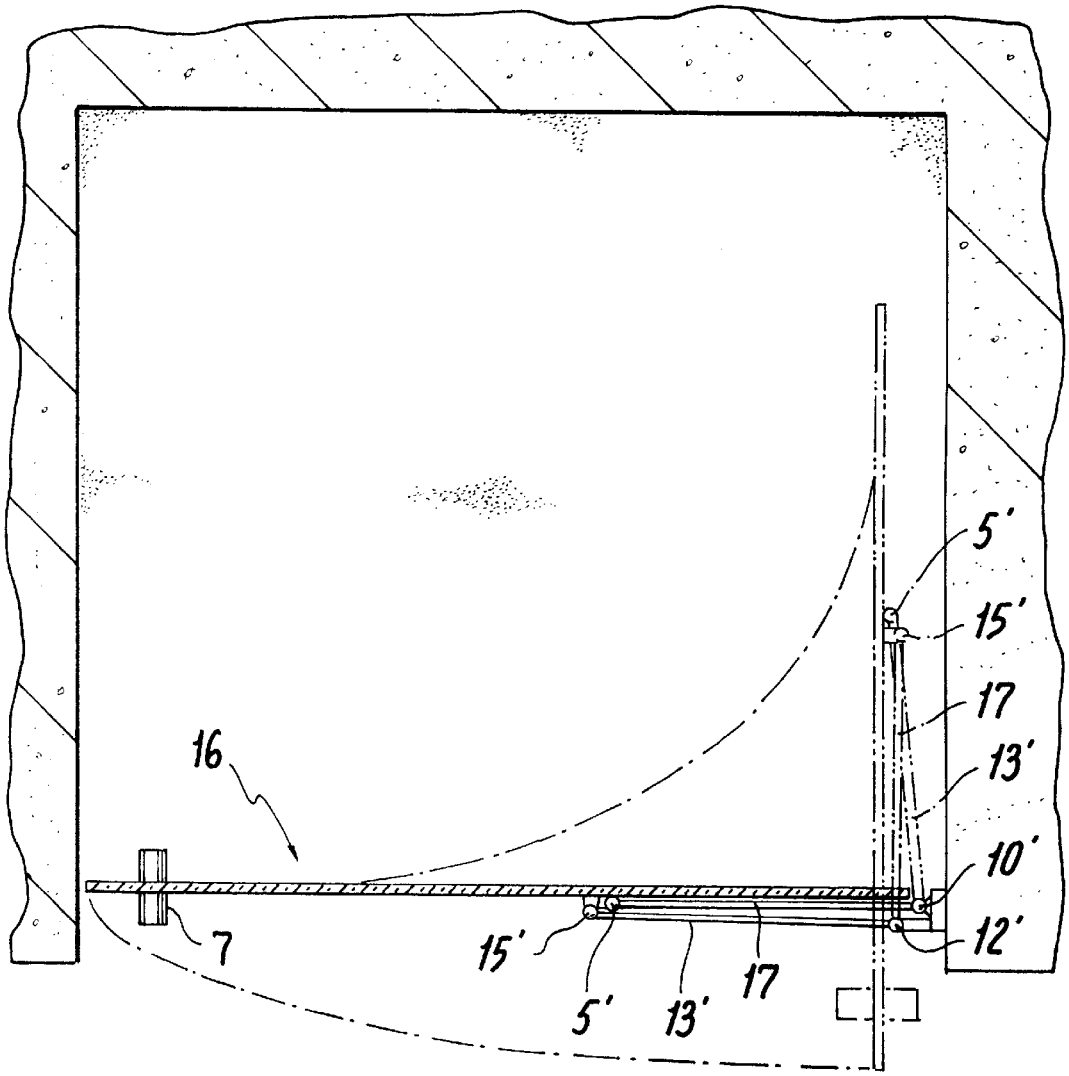
FIG. 12: a view corresponding to FIG. 4 of the door of FIGS. 6–11.

In addition, the door according to the invention, in this exemplary embodiment, has one or more retaining arms 17, which are disposed vertically spaced apart from the one or more retaining arms 13', and which as shown in FIGS. 9–11 are spaced apart by a lesser distance from the outside of the door leaf 16 than the retaining arm 13'. The retaining arm 17 is rotatably supported on one outer side at a defined lateral spacing in the suspension part 4' with the rotary axis 5'; the suspension part 4' is disposed laterally of the suspension part 14', in the direction of the suspension part 11' of the hinge element 9'. The suspension part 4' is likewise rigidly mounted in a known manner to the door leaf 16, for instance by screw fastening or adhesive bonding. By its other lateral end, the retaining arm 17, like the door leaf 2 in the exemplary embodiment of FIGS. 1–5, is articulated rotatably on the suspension part 8' with the rotary axis 10' of the hinge element 9". The hinge element 9' with the suspension part 11" on the one hand, and the hinge element 9" with the suspension part 8' on the other, are, in contrast to the double hinge element 9, necessarily separate components. The suspension part 8' with the rotary axis 10', however, is likewise laterally offset from the suspension part 11' with the rotary axis 12' at a defined spacing, specifically being closer to the outer wall of the room or to the corner profile of the shower enclosure or corner shower.

The rotary axes 5' and 10' on the one hand, and the rotary axes 12' and 15' on the other, likewise have defined spacings S 3 and S 4, as shown in FIG. 9, specifically such that the spacing S 3 is greater than the spacing S 4. Moreover, in this embodiment as well, the direct spacing between the rotary axes 5' and 15' is less than the direct spacing between the rotary axes 10' and 12'.

In the exemplary embodiment of FIGS. 6–13 now being described, the angle ratios shown for the exemplary embodiment of FIGS. 1–5 again result between the imaginary horizontal lines between the rotary axes 5', 10', 12' and 15', as shown in FIG. 14 for the door in the closed state and in FIG. 15 for the door in the fully opened state.

Figure 13:
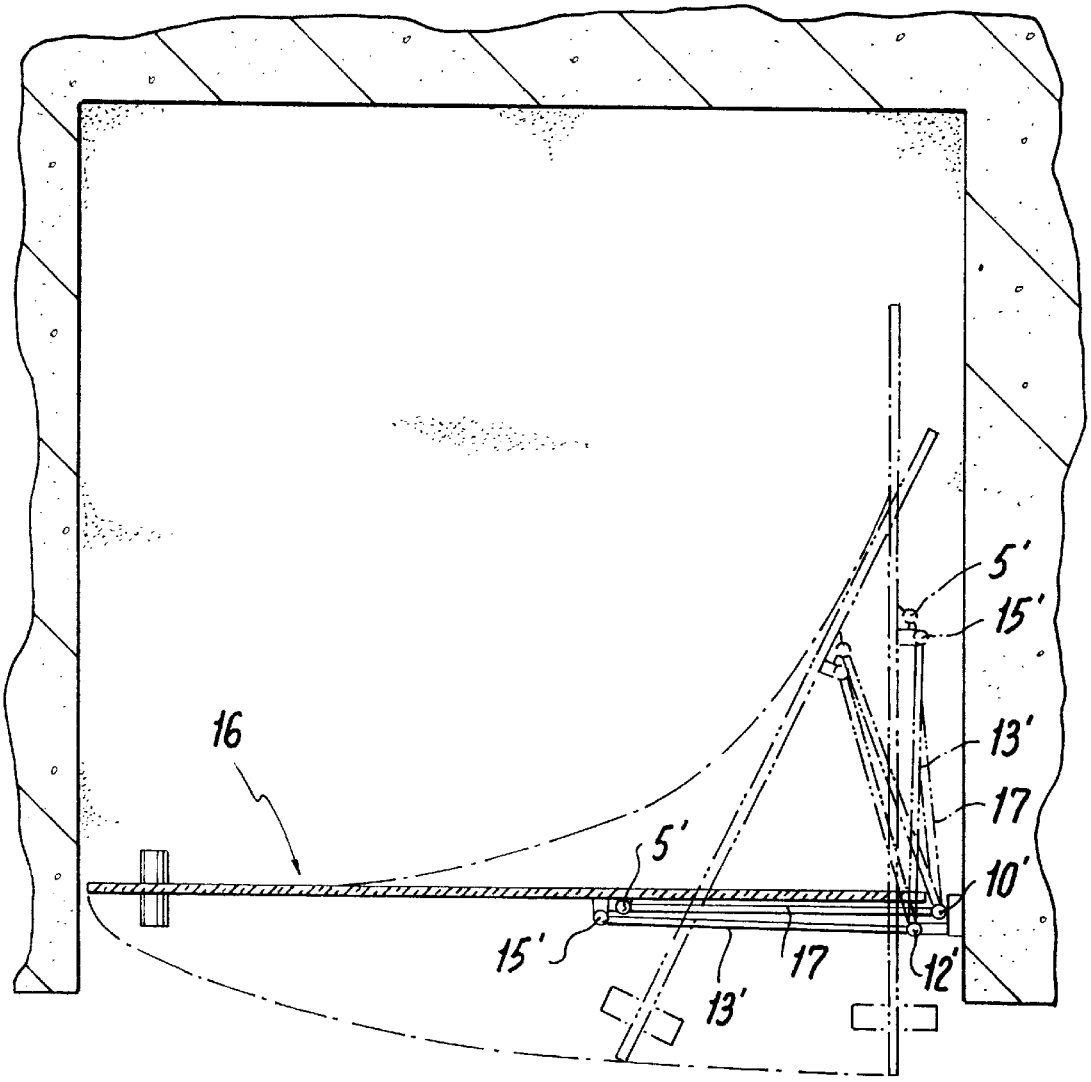
FIG. 13: a view corresponding to FIG. 4 of the door of FIG. 5.

If the user of the shower pulls on the handle 7 of this embodiment of the door 1, or conversely presses it outward from the shower area, then the course of motion shown in FIG. 13 results. The door leaf 16 rotates via the rotary axes 15' and 12' of the retaining arm 13' on the one hand and the rotary axes 5' and 12' of the retaining arm 17 on the other into the shower area with its side toward the room wall or the corner profile of the shower enclosure, and at the same rotates with its opposite outside into the room in front of the shower enclosure. At the same time, the door pivots via the retaining arms 13' and 17 and the rotary axes 5', 10', 12', 15' toward the lateral outer wall of the room or shower enclosure until it reaches a parallel final position. Once again, the door leaf 16 sweeps only a slight portion of the shower area 6 and also sweeps only a small area of the room outside the shower enclosure. In the open position, as in the exemplary embodiment of FIGS. 1–5, the door protrudes with only a slight portion of its width into the room outside the shower enclosure, specifically depending on the lengths of the retaining arms 13' and 17 and on the mounting of the suspension parts 4' and 14' on the door leaf 16. Depending on the lateral spacing of these suspension parts 4' and 14' and correspondingly on the lengths of the retaining arms 13' and 17, the area swept by the door inside and outside the shower area can also be varied.

The door according to the invention for shower enclosures has the considerable advantage on the one hand that in the open state, it furnishes the user of the shower enclosure with an entry space that corresponds to virtually the entire width of the door in the closed state. It requires no frame profiles as guides on the bottom or on the upper edge of the tub or shower pan and/or on the upper end of the shower enclosure. Its further advantage is that the predominant portion of the door area on opening of the door pivots into the shower space or over the shower pan rather than into the free space in front of the shower enclosure; water sticking to the door after it is opened is therefore prevented from dripping from a large area into the outer room. In both embodiments described, when the door is opened and closed, only a small area of the space inside the shower enclosure and at the same time only a slight area outside the shower enclosure are swept. Thus there is only slight limitation particularly to the space remaining to the user inside the shower enclosure when the door is opened and closed. Complicated guides with cantilevered arms as in German Utility Model DE-G 92 03 008.4 are also unnecessary in the door of the invention. Nor is there any danger of warping, so that thin, lightweight door panels can be used, and at the same time frames and other reinforcements for the two door leaves or for the actual door leaf, in the two embodiments described, can be dispensed with. Because of the design according to the invention, the guidance of the door on opening and closing is reliable and durable, even if it is not very carefully used. At the same time, complicated sealing provisions as in known doors of shower enclosures of the type referred to at the outset are unnecessary. Finally, the invention provides a considerably better design esthetically than the known doors.

We claim:

1. A door for shower enclosures, comprising at least two door leaves disposed side-by-side in a closed state of the door; a continuous vertical hinge element connecting said door leaves so that upon opening of the door one of said door leaves pivots forward about a rotary axis of said hinge element; a double hinge element mountable on one wall of a shower area or on a vertical profile of a shower enclosure and having a rear suspension part and a front suspension part, another of said door leaves being supported rotatably at one end on a rotary axis of said rear suspension part of said double hinge element; at least one horizontally disposed retaining arm which is articulated rotatably at one end about a rotary axis on said front suspension part of said double hinge element which is spaced farther from the shower area than said rear suspension part, said retaining arm fitting over said vertical hinge element and being supported rotatably at an opposite end in a further rotary axis on a further suspension part mounted rigidly on said hinge element.

2. A door as defined in claim 1, wherein said retaining arm is disposed midway along the height of one of said door leaves.

3. A door as defined in claim 1, and further comprising two retaining arms including one retaining arm provided in an upper region of one of said door leaves and another retaining arm provided in a lower region of said one door leaf.

4. A door as defined in claim 1, wherein at least one of said door leaves is frameless and composed of a material that is both rigid and torsion-proof.

5. A door as defined in claim 4, wherein said material is a material selected from the group consisting of glass, hard plastic, metal and wood.

6. A door as defined in claim 1, wherein the door has at least four vertical rotary axes formed so that an inside angle between a horizontal line extending between a fourth vertical rotary axis and a first vertical rotary axis and a horizontal line extending between said first rotary axis and a second rotary axis is greater than an inside angle between a horizontal line extending between a third rotary axis and said fourth rotary axis and a horizontal line extending between said second rotary axis and said third rotary axis in a closed state of the door.

7. A door as defined in claim 6, wherein in a completely open state of the door an inside angle between a horizontal line extending between said fourth vertical rotary axis and said first vertical rotary axis and a horizontal line extending between said first rotary axis and said second rotary axis is smaller than said inside angle between a horizontal line extending between said third rotary axis and said fourth rotary axis and a horizontal line extending between said second rotary axis and said third rotary axis.

8. A door as defined in claim 1, wherein said door has at least four vertical rotary axes arranged so that an inside angle between a horizontal line extending between a first rotary axis and a second rotary axis and a horizontal line extending between said second rotary axis and a third rotary axis is greater than an inside angle between a horizontal line extending between said third rotary axis and a fourth rotary axis and a horizontal line extending between said fourth rotary axis and said first rotary axis in a closed state of the door.

9. A door as defined in claim 8, wherein in a completely open state of the door, an inside angle between a horizontal line extending between said first rotary axis and said second rotary axis and a horizontal line extending between said second rotary axis and said third rotary axis is smaller than an inside angle between a horizontal line extending between said third rotary axis and said fourth rotary axis and a horizontal line extending between said fourth rotary axis and said first rotary axis.

10. A door as defined in claim 1, wherein the door has at least four rotary axes formed so that an inside angle between a horizontal line extending between a third rotary axis and a fourth rotary axis and a horizontal line extending between a second rotary axis and said third rotary axis is smaller than an inside angle between a horizontal line extending between said third rotary axis and said fourth rotary axis and a horizontal line extending between said fourth rotary axes and a first rotary axis.

11. A door as defined in claim 1, wherein the door has at least four vertical rotary axes formed so that an inside angle between a horizontal line extending between a fourth rotary axis and a first rotary axis and a horizontal line extending between said first rotary axis and a second rotary axis is smaller than an inside angle between a horizontal line extending between said first rotary axis and said second rotary axis and a horizontal line extending between said second rotary axis and a third rotary axis.

12. A door as defined in claim 1, wherein the door has at least four vertical rotary axes formed so that a space between a first rotary axis and a second rotary axis is greater than a space between a third rotary axis and a fourth rotary axis.

* * * * *